United States Patent [19]

Komaki

[11] Patent Number: 4,640,994

[45] Date of Patent: Feb. 3, 1987

[54] ELECTRONIC APPARATUS WITH A FLAT PANEL KEYBOARD UNIT

[75] Inventor: Shigeki Komaki, Nara, Japan

[73] Assignee: Sharp Kabushiki Kaisha, Osaka, Japan

[21] Appl. No.: 827,199

[22] Filed: Feb. 7, 1986

Related U.S. Application Data

[63] Continuation of Ser. No. 724,503, Apr. 19, 1985, abandoned, which is a continuation of Ser. No. 568,341, Jan. 5, 1984, abandoned.

[30] Foreign Application Priority Data

Jan. 24, 1983 [JP] Japan ..... 58-10184

[51] Int. Cl.[4] ..... H01H 13/70

[52] U.S. Cl. ..... 200/5 A; 200/159 B; 200/264

[58] Field of Search ..... 200/5 A, 5 R, 159 B, 200/264, 265

[56] References Cited

U.S. PATENT DOCUMENTS

| | | | |
|---|---|---|---|
| Re. 28,595 | 10/1975 | DuRocher | 200/265 X |
| 3,860,771 | 1/1975 | Lynn et al. | 200/5 A |
| 3,862,381 | 1/1975 | Glaister et al. | 200/5 A |
| 3,911,234 | 10/1975 | Kotaka | 200/5 A |
| 3,959,610 | 5/1976 | Finnegan | 200/5 A |
| 4,050,756 | 9/1977 | Moore | 200/265 X |
| 4,075,702 | 2/1978 | Davies | 364/705 |
| 4,096,577 | 6/1978 | Ferber et al. | 364/712 |
| 4,158,230 | 6/1979 | Washizuka et al. | 220/33 |
| 4,180,711 | 12/1979 | Hirata et al. | 200/5 A |
| 4,228,329 | 10/1980 | Inose et al. | 200/54 |
| 4,231,577 | 11/1980 | Thomas et al. | 273/238 |
| 4,251,734 | 2/1981 | Mayer et al. | 290/5 |
| 4,261,042 | 4/1981 | Ishiwatari et al. | 364/709 |
| 4,263,659 | 4/1981 | Hirata et al. | 364/709 |
| 4,308,439 | 12/1981 | Itoh | 200/5 E X |
| 4,314,117 | 2/1982 | Ditzig | 260/5 A |
| 4,375,018 | 2/1983 | Petersen | 200/5 A |

*Primary Examiner*—J. R. Scott

*Attorney, Agent, or Firm*—Birch, Stewart, Kolasch & Birch

[57] ABSTRACT

A flat panel keyboard unit comprises a first flexible member having a key symbol printed thereon, a second flexible member having electrodes aligned with the kay symbol, a pressure sensitive conductive element provided at a position corresponding to the electrodes and a base for accommodating the pressure sensitive conductive element. The flat panel keyboard is used in an electronic apparatus.

5 Claims, 5 Drawing Figures

ELECTRONIC APPARATUS WITH A FLAT PANEL KEYBOARD UNIT

This application is a continuation of application Ser. No. 724,503, filed on Apr. 19, 1985, now abandoned which is a continuation of application Ser. No. 568,341, filed 1/5/84, now abandoned.

BACKGROUND OF THE INVENTION

The present invention relates to a keyboard construction and, more particularly to a flat panel keyboard unit for an electronic apparatus using a pressure sensitive conductive material as contacts.

Conventionally, touch-keyboard units as shown in FIGS. 1A, 1B and 2 are proposed for an electronic apparatus such as an electronic calculator and the like. For example, the keyboard unit of FIGS. 1A, and 1B is disclosed in U.S. Pat. No. 3,911,234, issued on Oct. 7, 1975, by Yasumasa KOTAKA, entitled "KEYBOARD TYPE SWITCH ASSEMBLY HAVING FIXED AND MOVABLE CONTACTS DISPOSED ON FOLDABLE FLEXIBLE PRINTED CIRCUIT BOARD". The keyboard unit of FIGS. 1A, and 1B comprises a flexible ornamental plate 11 made of a polyester film and the like, printed key symbols thereon, a flexible base 12 having a key switching wiring pattern thereon, a spacer 13 provided with apertures (13-1) corresponding to the positions of each of the electrodes of the wiring pattern, and a support plate 14.

The flexible base 12 is folded, so that an upper electrode pattern and a lower electrode pattern face each other. The spacer 13 is inserted between the upper electrode pattern 12-1 and the lower electrode pattern 12-2. The layers are adhered to each other by the adhesive 15. 11-1 designates a key symbol printed section and 12-3 designates an electrode drawing portion. The combination of the flexible base 12 and the spacer 13 is sandwiched between the ornamental plate 11 and the support plate 14, so that the flexible base 12, the spacer 13, the support plate 14 are adhered by the adhesive 15.

On the other hand, the keyboard unit of FIG. 2 comprises an ornamental plate 21 formed with key contacts on the back surface of the ornamental plate 21 by a conductive ink, a hard base 26 formed with a key wiring parttern on one surface of the hard base 26, and a spacer 23. 27 designates an LSI and 28 designates a cabinet. The ornamental plate 21, the spacer 23, and the hard base 26 are stacked and adhered together.

In the above conventional keyboard units as shown in FIGS. 1(1), 1(2), and 2, required key operating pressure is great due to the spacer and the like. If the keyboard unit is operated for a long time, the user's fingers become very tired. To reduce the above problems, the spacer may be made thinner and a diameter of each aperture of the spacer made larger. Keys may then close, however, due to a little vibration, so that misoperation of the key inputs occurs.

Particularly, in the keyboard unit of FIG. 2, the key electrodes become shorted by the possible distortion of the ornamental plate 21 printed with the key symbols thereon if the keyboard unit is used for a long period. Also, the outline of the spacer may appear through the surface of the ornamental plate 21 impairing the appearance of the apparatus. If these keyboard units are used in electronic apparatus such as an electronic calculator, it is difficult for the electronic calculator to be made very thin.

SUMMARY OF THE INVENTION

In view of the above disadvantages of the conventional devices, an object of the present invention is to provide a flat electronic apparatus by utilizing a flat panel keyboard unit.

Another object of the present invention is to provide a flat thin panel keyboard unit requiring light key operating pressure.

Still another object of the present invention is to provide a flat panel keyboard unit without a spacer member.

Still another object of the present invention is to provide a flat panel keyboard unit using a pressure sensitive conductive material such as a pressure sensitive conductive rubber.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

According to an embodiment of the present invention, a flat panel keyboard unit comprises first flexible means having a key symbol, second flexible means having electrode means corresponding to said key symbol, pressure sensitive conductive means provided at the position corresponding to said electrode means and base means for accomodating the pressure sensitive conductive means. According to another embodiment of the present invention, an electronic apparatus comprises first flexible means having a key symbol, second flexible means having electrode means corresponding to said key symbol, pressure sensitive conductive means provided at the position corresponding to said electrode means, and base means for accomodating the pressure sensitive conductive means.

The pressure sensitive conductive means is a pressure sensitive conductive rubber. For example, the pressure sensitive conductive means is made of a silicone rubber containing long-life metal grains of a metal such as nickel.

BRIEF DESCRIPTION OF THE DRAWINGS

The present invention will be better understood from the detailed description given hereinbelow and the accompanying drawings which are given by way of illustration only, and thus are not limitative of the present invention and wherein.

DETAILED DESCRIPTION OF THE INVENTION

Figure 3:
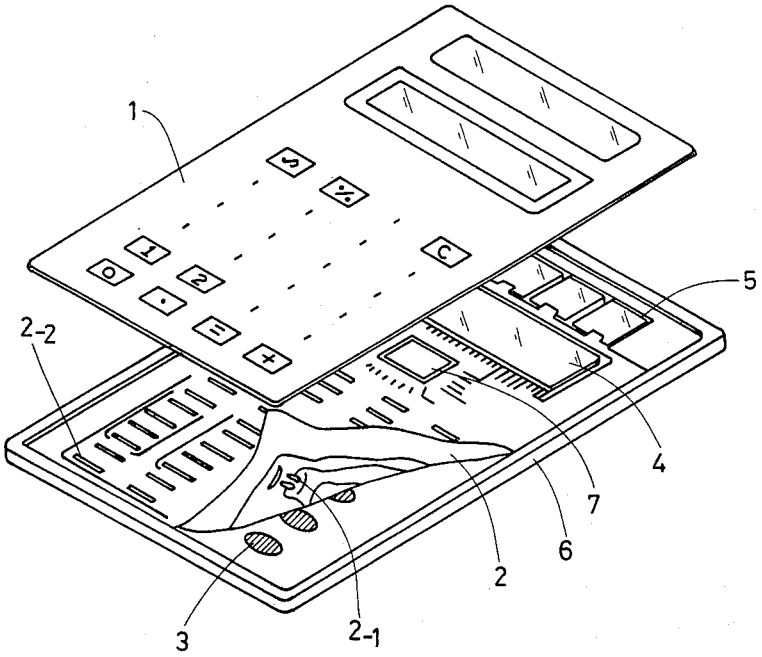
FIG. 3 shows a perspective view of an electronic calculator having a flat panel keyboard unit according to the present invention.
Figure 4:
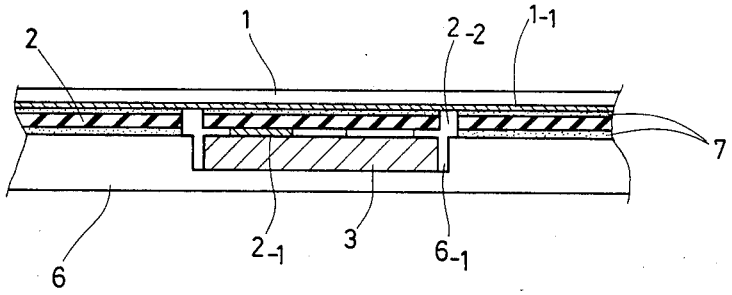
FIG. 4 shows a cross sectional view of FIG. 3.

Referring now to FIGS. 3 and 4, there is illustrated an electronic calculator using a preferred embodiment of a flat panel keyboard unit of the present invention, which electronic calculator comprises a flexible plate 1 serving as an ornamental plate printed with key symbols, a flexible base 2 formed with a connecting wiring pattern and a key wiring pattern, a display 4, a solar cell 5, an LSI 7, a group of pressure sensitive conductive material elements 3 such as pressure sensitive conductive rubber, and a cabinet or case 6. The flexible plate 1, the flexible base 2, and the cabinet 6 are adhered, respectively.

The flexible plate 1 as the ornamental plate is made of a polyester film and the like, and is provided with transparent windows positioned to correspond to the display 4 and the solar cell 5. The key symbols are printed on the back surface of the flexible plate 1, so that the key symbols cannot be touched by the operator.

The flexible base 2 is made of polyimide rubber and the like. The connecting wiring pattern and the key wiring pattern including comb-shaped key electrodes 2-1 are mounted on the flexible base 2 and are wired for the display 4, the solar cell 5, the LSI, and the other electronic circuit parts. The comb-shaped key electrodes 2-1 for the key wiring pattern on the flexible base 2 are aligned with the key symbols, respectively. Slits 2-2 are provided on both sides of each pair of the comb-shaped electrodes to facilitate the up-down actuation of the flexible base 2 at the comb-shaped electrodes, so that the load required for key actuation can be reduced.

The area of each of the pressure sensitive conductive rubbers 3 is about the same as the area of the corresponding pair of the comb-shaped electrodes. For example, the pressure sensitive conductive material 3 is made of a silicone rubber containing long-life metal grains (for example, nickel or the like). If the stress is not applied to the pressure sensitive conductive rubber 3, the electrical resistance of the pressure sensitive conductive rubber 3 is relatively large (several 10MΩ), so that the pressure sensitive conductive rubber 3 is not conductive. On the other hand, when pressure force is applied to the pressure sensitive conductive rubber 3, the resistance of the pressure sensitive conductive rubber 3 is substantially reduced (several 10Ω), so that the pressure sensitive conductive rubber 3 is conductive. If the flat panel keyboard unit of an present invention is used in the electronic calculator, key inputs "ON" can be detected when the resistance of the pressure sensitive conductive rubber 3 is less than about 2KΩ. Such a pressure sensitive conductive rubber 3 is produced by JAPAN SYNTHETIC RUBBER CO. LTD, Japan under the name of "JSR PCR".

A plurality of the pressure sensitive conductive rubber elements 3 are placed in respective concave portions 6-1 formed in the inside surface of the cabinet 6. The concave portions 6-1 are provided by etching or cutting. The cabinet 6 is itself formed in a concave-shape by pressing a metal plate such as a stainless steel and the like. Also, the cabinet 6 may be an insulating plate formed with a conductive member thereon.

With a flat panel keyboard unit as described above, when the key symbols of the flexible plate 1 are depressed, the comb-shaped electrodes 2-1 corresponding to the depressed key symbol are pressed down, so that the aligned pressure sensitive conductive rubber 3 becomes conductive.

When necessary pressure force is applied to the pressure sensitive conductive rubber 3, the pressure sensitive conductive rubber 3 becomes conductive, and the comb-shaped electrodes 2-1 are shorted by the pressure sensitive conductive rubber 3. Accordingly, the key input signal is generated and detected.

Figure 1A:
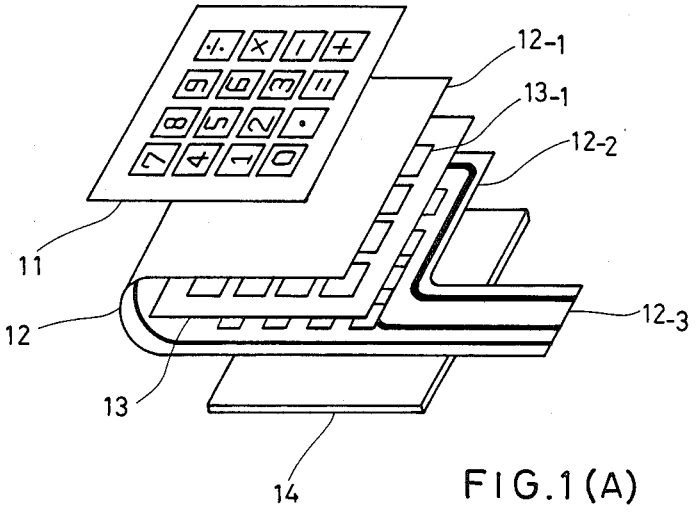
FIG.1(A) PRIOR ART
FIG. 1A shows an exploded view of a conventional keyboard unit.
Figure 1B:
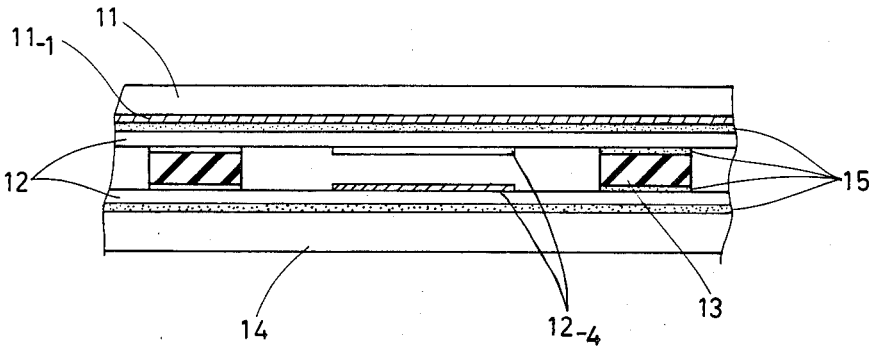
FIG.1(B) PRIOR ART
FIG. 1B shows a cross sectional view of an assembled device as shown in FIG. 1A.
Figure 2:
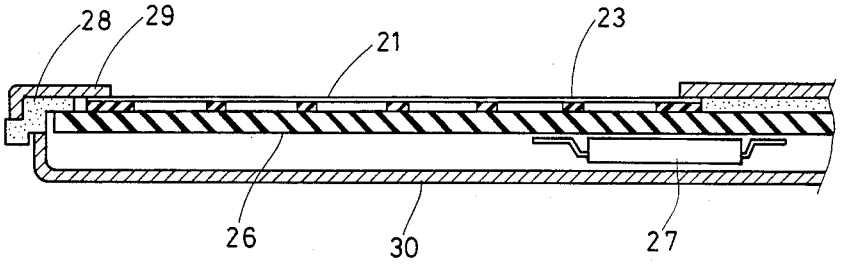
FIG. 2 PRIOR ART
FIG. 2 shows a cross sectional view of another conventional keyboard unit.

The required operating pressure of the flat panel keyboard unit of the present invention is dependent only on the flexibility of the plate 1 and the base 2. Because the spacer is not used in the flat panel keyboard of the invention, the thickness of the spacer and the diameter of each of the apertures in the spacer do not affect the operating load. A shock applied to the user's fingers is reduced by the elasticity of the pressure sensitive conductive rubber 3. Conventionally, the load to be applied to each of the key switches such as shown in FIGS. 1A, 1B and 2 is about 30–40 g. According to the present invention, the load can be reduced to as little as about 10 g.

Even if the flexible plate becomes distorted, no short circuiting is possible. Since the flexible base 6 is also employed for a bottom surface of the electronic calculator, the electronic calculator is made thin.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A flat panel keyboard comprising:

a flexible user-actuable surface plate having a plurality of key symbols adhered to the surface thereof which are visible to a user;

a flexible base with a connecting wiring pattern and key electrode pattern on the rear surface thereof, said key electrode pattern being a pair of electrodes in alignment with said plurality of key symbols;

a flexible cabinet member having a plurality of integral recessed portions in alignment with said key electrode pattern; and a plurality of pressure sensitive conductive means positioned in said plurality of recessed portions, wherein said plurality of key electrode patterns are in continuous surface contact with said plurality of pressure sensitive conductive means so that upon actuation of one of said plurality of key symbols on said flexible user-actuable surface plate, a corresponding electrode pattern is forced against a respective pressure sensitive conductive means, shorting said electrode pattern and generating a signal;

said surface plate, said flexible base, and said flexible cabinet member being adhered together in a flat compact relationship, said flexible base includes a plurality of slits formed therein on either side of each of said pair of electrodes to facilitate an up-down actuation of said flexible base.

2. The flat panel keyboard of claim 1, wherein the pressure sensitive conductive means is a pressure sensitive conductive rubber.

3. The flat panel keyboard of claim 1, wherein the pressure sensitive conductive means is made of a silicone rubber containing metal particles.

4. The flat panel keyboard of claim 3, wherein the metal is nickel.

5. The flat panel keyboard of claim 1, wherein said flexible user-actuable surface plate and said flexible base with a connecting wiring pattern and key electrode pattern on the rear surface thereof constitutes a flexible panel means.

* * * * *